United States Patent [19]

Choinski

[11] 4,362,122

[45] Dec. 7, 1982

[54] FLUID DISPENSING SYSTEM

[75] Inventor: Edward J. Choinski, Wayland, Mass.

[73] Assignee: Polaroid Corporation, Cambridge, Mass.

[21] Appl. No.: 260,361

[22] Filed: May 4, 1981

[51] Int. Cl.[3] ..... B05B 12/00; B05C 5/02

[52] U.S. Cl. ..... 118/600; 137/429; 222/135; 222/395; 118/610; 118/407; 118/410; 118/411

[58] Field of Search ..... 118/610, 603, 412, 407, 118/411, 410, 600; 222/395, 135; 137/429; 417/392

[56] References Cited

U.S. PATENT DOCUMENTS 769,372 9/1904 Allen ..... 222/395
916,132 3/1909 Evans ..... 222/395 X
2,923,438 2/1960 Logan et al. ..... 222/135 X
3,289,632 12/1966 Barstow ..... 118/412

*Primary Examiner*—Shrive P. Beck
*Attorney, Agent, or Firm*—John W. Ericson

[57] ABSTRACT

A fluid dispensing system for uniformly dispensing relatively small quantities of one or more coating fluids. Each coating fluid is disposed in a vertically oriented cylindrical container and divided from a Newtonian drive fluid by a split floating plug. The drive fluid is advanced into the cylinder by a positive displacement pump at a constant rate. The split floating plug facilitates degassing of the fluid and allows it to be substantially completely dispensed at constant rate. A plurality of containers may be connected in a battery to facilitate a rapid change in the compositional parameters of a multiple layer coating system.

10 Claims, 10 Drawing Figures

FLUID DISPENSING SYSTEM

This invention relates to fluid dispensing, and particularly to novel apparatus for dispensing relatively small quantities of coating fluid at a uniform rate.

In U.S. Application Ser. No. 260,331, filed on May 4, 1981 by Edward J. Choinski for Process Simulator, methods and apparatus are disclosed which facilitate the rapid preparation of samples of material processed under a sequence of different conditions. A particular application of this process involves the preparation of relatively small sections of photosensitive products comprising a web coated with photosensitive emulsions, for the purpose of determining optimum process parameters for the manufacture of particular products.

In the process simulator described in Application Ser. No. 260,331, a strip of web is transported through a coating station at a selected constant speed while a uniform coating is applied to a relatively short section of the web. The coated section is then further processed in one or more steps (for example, of chilling and drying), during each of which the section is held stationary, in a manner that simulates conventional process steps carried out on a moving web without requiring the large physical space and long lengths of processed web associated with conventional processes.

While conventional coating apparatus and methods can be employed in preparing samples of photographic products made by the simulating process disclosed in the above cited application, optimum advantage of the inherent speed of the process cannot be taken with such conventional methods and apparatus because of the time required to establish coating conditions, the apparatus involved in supplying coating compositions to the coating station, and the amounts of solutions that must be purged and cleansed out of the system when changing solutions. A principle object of this invention is to facilitate the coating of relatively small sections of web with small total quantities of coating compositions which may rapidly be changed in composition and flow rate to allow the preparation of coated samples of different characteristics within a relatively short time.

Briefly, the above and other objects of the invention are accomplished by apparatus comprising batteries of cartridges, each cartridge being adapted to contain coating composition and being prepared for use by partially filling with a predetermined quantity of coating composition to be dispensed during a given run. Each cartridge comprises a cylinder adapted to be vertically oriented. Upon introducing the appropriate quantity of coating composition into a cartridge, a split floating plug is inserted in the cartridge, which floats on the coating composition. The cartridge is then connected to a source of vacuum to remove gasses from the coating composition, during which operation the split plug separates to allow the gasses to be pumped out of the liquid. Each cartridge is then topped off with deaerated water and assembled with other cartridges in a battery. The assembled battery is then installed in the feed lines for a coating applicator. The feed lines can be relatively short, and of small volume, so that they can be quickly purged and cleaned in preparation for the coating of each sample of web. The batteries are then connected to a battery of positive displacement pumps, which effect the movement of a Newtonian fluid into the cartridges at predetermined rates to drive the enclosed coating compositions out into the coating applicator at a corresponding set of constant rates. When the drive fluid moves the split plug in a cartridge into an extreme position at the end of the cartridge, as the last of the coating composition has moved out into the associated applicator feed line, the plug again splits to allow the passage of the driving fluid without the production of a hydraulic shock.

The apparatus of the invention and its mode of operation will best be understood in the light of the following detailed description, together with the accompanying drawings, illustrative of the practice of the invention.

Figure 1:
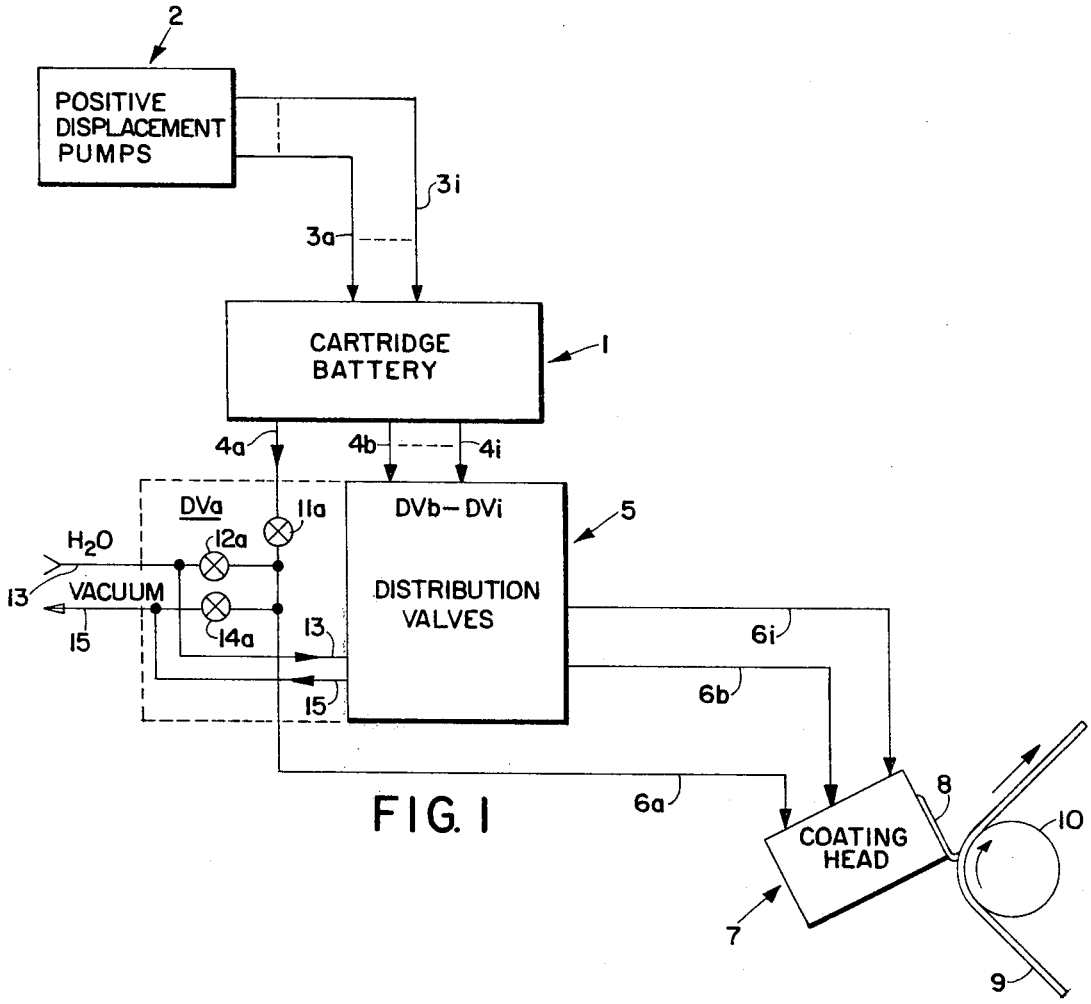
FIG. 1 is a schematic block diagram of a coating system in accordance with the invention.

FIG. 1 shows a coating system in accordance with the invention in which coating fluids contained in a cartridge battery 1, to be described in more detail below, are loaded in advance in quantities determined by the coating process to be carried out. The invention in its broader aspects is useful in the application of a single coating to a web, but is especially adapted to the simultaneous application of a plurality of coatings, as in the preparation of photographic products where a plurality of layers of different compositions and coverages are applied simultaneously to a web. For this purpose, the cartridge battery 1 will contain at least one cartridge for each layer of coating composition to be applied. For many purposes, it may be desired to blend several compositions for a particular layer, just before application, and for such purposes the cartridge battery may contain several cartridges for a particular layer, the contents of these cartridges being blended just prior to application.

Dispensation of the several compositions in the cartridge battery 1 is carried out under the control of a set of positive displacement pumps 2, one for each cartridge in the cartridge battery 1, which at times dispense drive fluids to the several cartridges of the battery 1 over a plurality of independent conduits 3a–3i, one for each cartridge in the battery 1. While any desired number of cartridges and corresponding drive lines 3a–3i may be employed, for clarity of description an example will be given by way of illustration in which there are nine cartridges, such that there are nine drive conduits 3a–3i driven by nine independent positive displacement pumps in the set of pumps 2. The drive fluids in the lines 3a through 3i may each be supplied at a different controlled flow rate, corresponding to the desired flow rates of the different coating compositions in the individual cartridges in the cartridge battery 1. Preferably, the drive fluids are Newtonian, water being a preferred example of a suitable drive fluid.

Coating fluids driven from the cartridges in the battery 1 by fluid applied to the lines 3a–3i is dispensed through lines 4a–4i, one for each cartridge in the battery 1. The coating compositions in the output lines 4a–4i from the cartridge battery 1 are each supplied to a different one of a set of distribution valves 5, which may be operated in a manner to be described below to facilitate the cleaning of the system between runs.

During actual coating, the output lines such as 4a from the cartridge battery 1 are supplied over conduits 6a–6i, one for each cartridge in the battery 1, through valves such as 11a, which are open when coating fluid is being dispensed from the cartridge battery 1. The conduits 6a–6i are connected to the several inlet conduits of a coating head 7.

The coating head 7 may be of any conventional design, arranged for extrusion or gravity feed coating, either by application of a bead over a short distance between the coating head 8 and the web to be coated, or in a curtain coating arrangement or the like. For clarity of description, attention will be confined to a coating head of the gravity feed slide type, in which a multilayer coating 8 of liquids comprising distinct layers are fed by gravity over a small coating gap for application to a web 9 carried on a rotating coating roll 10 in a conventional manner.

Figure 2:
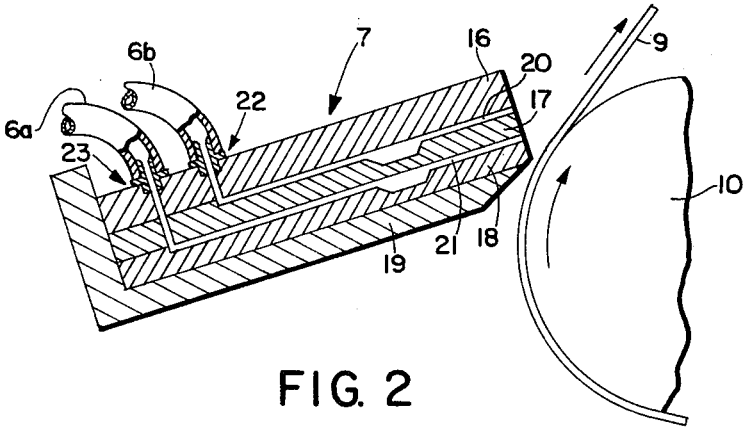
FIG. 2 is a diagrammatic cross-sectional elevational sketch, with parts shown in cross section and parts broken away, illustrating details of a typical coating head forming a portion of the system of FIG. 1.

FIG. 2 shows a typical coating head 7 in pertinent part, the showing being limited for simplicity to the illustration of apparatus for applying a two layer coating to the web 9 by means of a coating head 7 comprising three plates 16, 17, and 18 bolted together in a conventional manner, not shown, and supported on a bed plate schematically indicated at 19. Typical apparatus of this kind is shown and described in more detail, for example, in U.S. Pat. No. 3,289,632, issued on Dec. 6, 1966 to Frederick C. Barstow and assigned to the assignee of this invention.

As shown for the typical pair of output conduits 6a and 6b from the distribution valves 5, coating compositions are supplied to the coating head 7 by connection of the conduits 6a and 6b, through fittings schematically indicated at 22 and 23, to coating slots such as 20 and 21 milled in the plates 17 and 18, respectively, to cause fluid to flow out through the slots 20 and 21 in laminar flow and join into a set of discrete superposed layers which flow down over the end of the coating applicator and across a gap to the web 9.

The output conduits such as 6a and 6b from the distribution valves 5 are preferably of flexible material, as suggested in FIG. 2, and are preferably as short as possible to minimize the time, and the volume of fluids, required to clean the apparatus between runs.

Referring to FIG. 1, the distribution valves 5 comprise a set DVa through DVi, one set for each of the output conduits 4a–4i of the cartridge battery 1. Each set of distribution valves such as the set DVa comprises a valve such as 11a, referred to above, for directly connecting the output conduit 4a from the battery 1 to the input lead conduit such as 6a for the coating head 7.

The valve 11a is closed except during the coating operation. When it is closed, the apparatus may be flushed with water supplied from a line 13 through a valve 12a, which enables the last of the coating composition previously delivered to the coating head to be flushed out with water. When this has been accomplished, and the valve 12a closed, vacuum may be applied to the coating conduits such as 6a to exhaust fluid from the coating head 7 through a line 15 connected to a suitable vacuum pump and connectable to the outlet conduits 6a–6i through a valve 14a.

Figure 3:
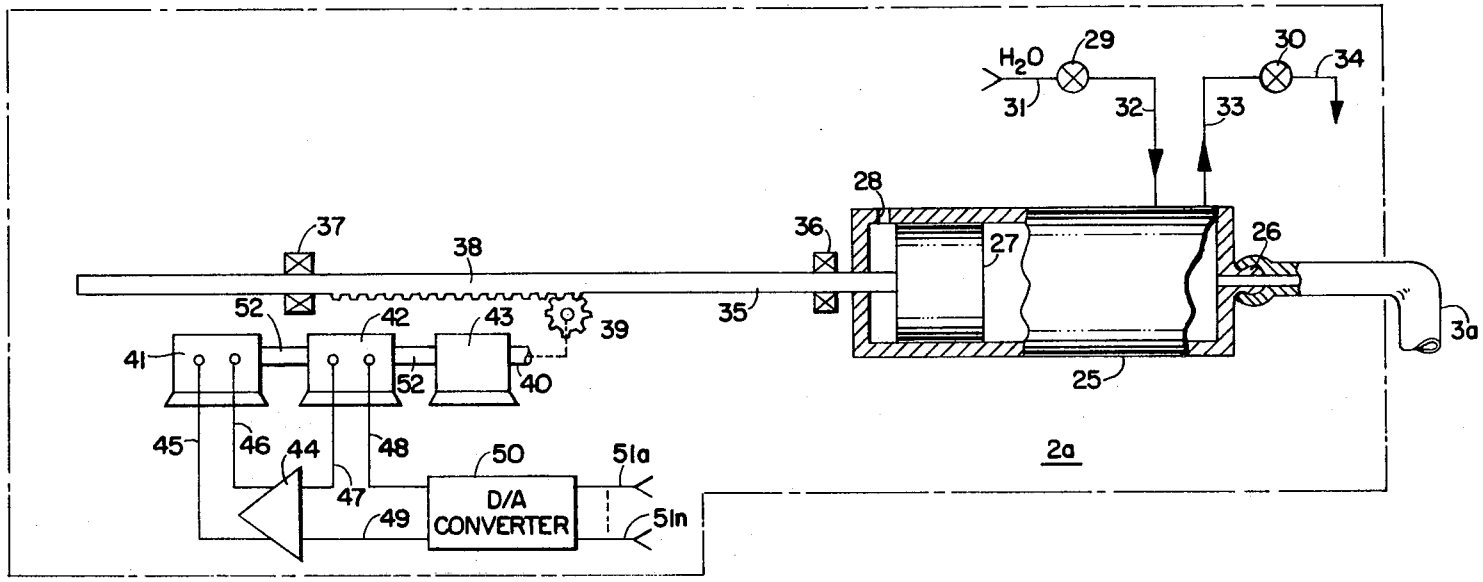
FIG. 3 is a schematic block and wiring diagram, with parts shown in cross section and parts broken away, illustrating a typical one of a series of controlled rate positive displacement pumps forming a portion of the system of FIG. 1.

Referring next to FIG. 3, there is shown a typical one 2a of the positive displacement pumps 2, together with appropriate apparatus for its control. The pump may comprise a cylinder 25 having an outlet fitting as indicated at 26 for connection to one of the outlet conduits 3a to supply fluid to the cartridge battery 1. As suggested in FIG. 3, the fluid conduits such as 3a are preferably of a suitable inert, flexible thermoplastic material, such as poly (tetrafluoroethylene) or the like.

A piston 27 in the cylinder 25 at times drives fluid, such as water, out into the line 3a at a constant selected rate. A vent to atmosphere, indicated at 28, may be provided behind the piston 27.

The cylinder 25 may be arranged to be filled with water through a suitable valve 29 connecting water from a supply line 31 to the cylinder over a conduit 32. Air or other gasses in the cylinder 25 may be vented, if desired, by means of a valve 30 connected between a conduit 33 leading to the cylinder 25 and a vent line 34.

The piston 27 is arranged to be driven by a shaft 35, guided in suitable bearings as indicated at 36 and 37, and formed intermediate its length with a conventional rack 38. The rack 38 is arranged to be driven by a gear 39 fixed to a shaft 40.

The shaft 40 is arranged to be driven at a selected constant speed by a conventional DC motor 41 having an output shaft 52 driving a conventional tachometer generator 42 and the input of a suitable conventional reduction gear unit 43. The gear unit 43 has the shaft 40 as its output shaft.

The motor 41 may be controlled either manually, through a conventional speed control circuit, or preferably, automatically under computer control. As schematically indicated, the control apparatus may comprise a conventional amplifier 44 having its output leads 45 and 46 connected to the input terminals of the motor 41.

The input circuit for the amplifier 44 may comprise a first terminal 47 connected to one output terminal of a conventional tachometer generator 42 driven by the shaft 52 of the motor 41 to provide a conventional speed feedback signal. The second terminal of the generator 42 is connected over a lead 48 to one output terminal of a conventional digital to analog converter 50, which has its other output terminal 49 returned to the input of the amplifier 44.

The digital to analog converter 50 may be any conventional apparatus for converting a digital speed command signal, applied on a set of leads 51*a*–51*n*, to an analog voltage suitable for comparison with the output of the tachometer generator 42. The speed of the motor 41, and the corresponding flow rate of delivery of the pump, comprising the piston 27 and the cylinder 25, to the output line 3*a*, may thereby be positively controlled under computer command.

The cartridge battery 1 of FIG. 1 will next be described in more detail with respect to FIGS. 4 and 5.

The cartridge battery 1 comprises a plurality of cartridges 55, one for each fluid to be dispensed in the coating run, here shown as 9 cartridges 55*a* through 55*i*, which may be prepared for dispensing in a manner to be described in more detail below and then confined between end plates 56 and 57 by means shown as a set of tie bolts 58 held in place by wing nuts 59.

Figure 4:
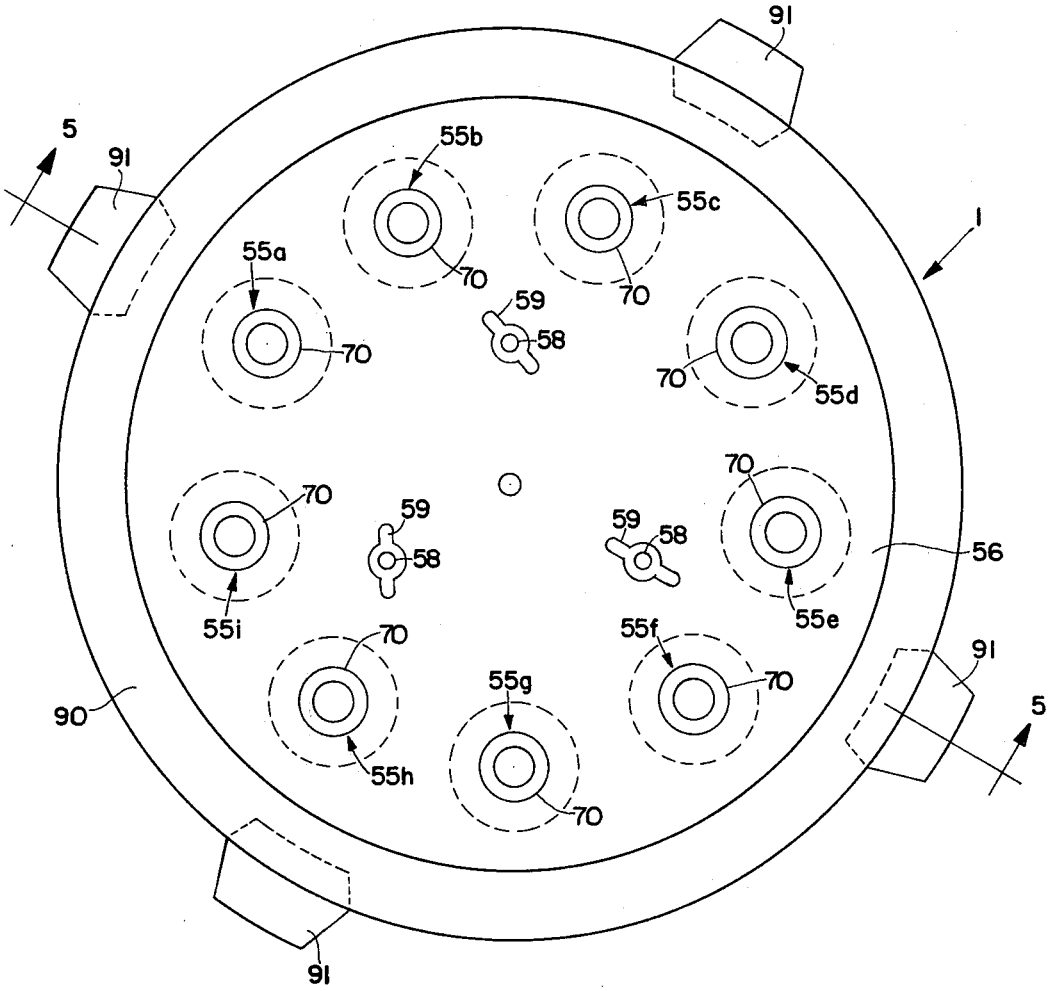
FIG. 4 is a schematic plan view of a cartridge battery forming a portion of the system 1, as seen substantially along the lines 4—4 in FIG. 5.
Figure 5:
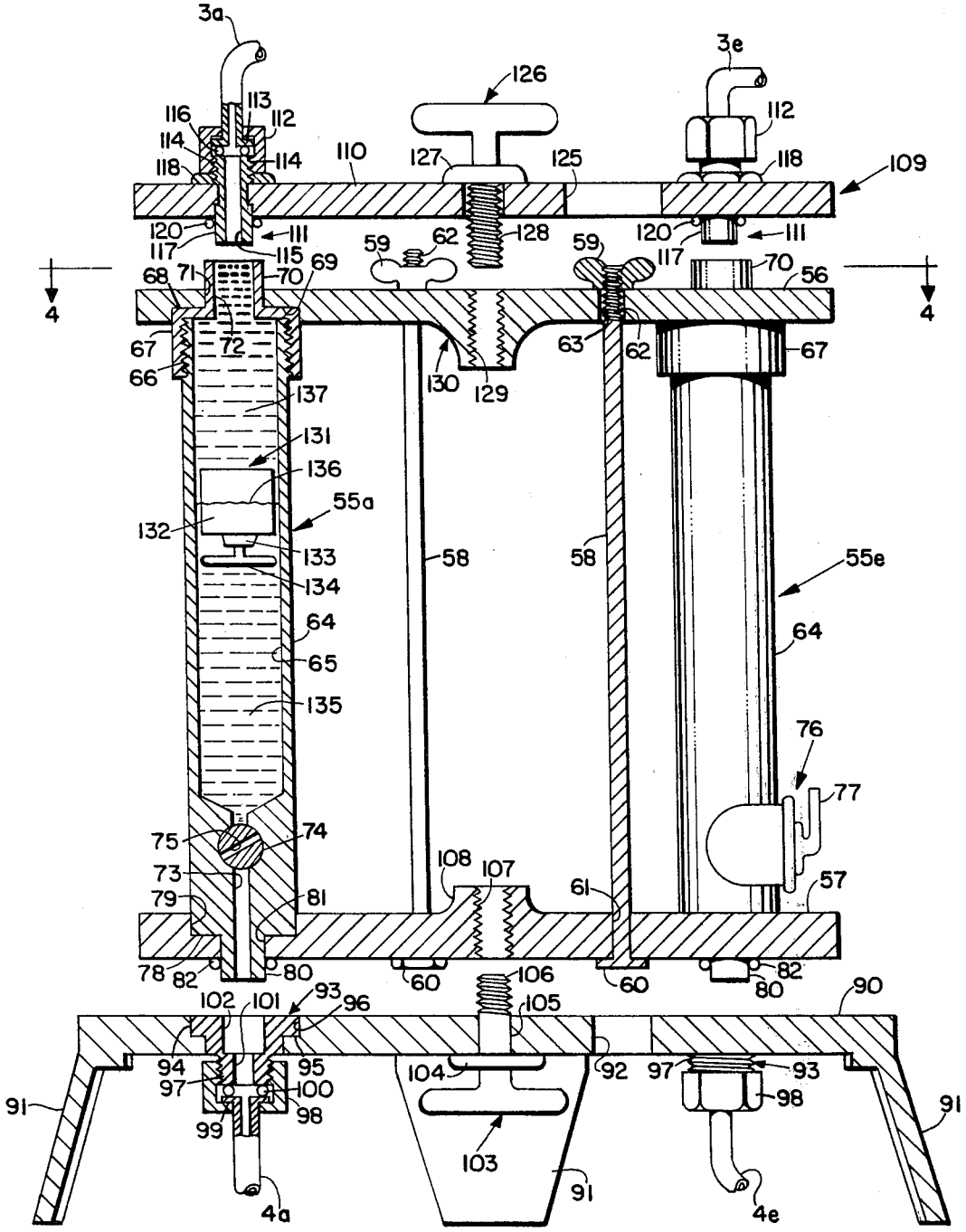
FIG. 5 is a diagrammatic cross-sectional view, with parts shown in cross section, parts omitted and parts broken away, showing the cartridge battery of FIG. 4 in its association with input and output flow distributor assemblies, as seen essentially along the lines 5—5 in FIG. 4.

Note that in comparing FIGS. 4 and 5, the cartridges 55*b*, 55*c*, and 55*d* shown in FIG. 4 have been omitted to avoid obfuscation of the drawings.

As shown in FIG. 5, each of the tie bolts such as 58 may be formed with a head 60 engaging one side of the plate 57. The shank of the bolt 58 passes through a suitable aperture 61 in the plate 57. The threaded ends 62 of the tie bolts 58 pass through suitable apertures such as 63 in the plate 56, and receive the wing nuts 59 in an obvious manner.

As shown in detail for the typical cartridge 55*a*, each cartridge comprises a cylindrical body portion 64 formed with a cylindrical central bore 65 to receive the coating composition to be dispensed. The cylindrical body portion 64 may be threaded as indicated at 66 to cooperate with corresponding threads formed in a cap 67.

The cap 67 is formed with a shoulder as indicated at 68 to engage the end 69 of a bore formed in the plate 56. An upstanding nipple 70 formed on the cap 67 passes through a reduced aperture 71 in the plate 56. A bore 72 in the nipple 70 communicates with the bore 65 in the cyliinder 64.

The cylindrical bore 65 in the cylinder 64 at times is placed in communication with an outlet conduit 73 by means of a valve comprising a body portion 74 received in a cooperating recess in the body of the cylinder 64 and formed with a port 75 that may be rotated into alignment with the outlet conduit 73. As shown by comparison of the typical cartridges 55*a* and 55*e*, the valve body 74 may form a portion of a conventional manually actuated valve generally designated 76, provided with a handle 77 for rotation by an operator.

The base of the cylinder 64 is formed with a shoulder 78 cooperating with a base of a corresponding bore 79 formed in the plate 57. A reduced nipple portion 80 of the cylinder 64 passes through an aperture 81 in the plate 57. A conventional seal, shown as an O-ring 82, may be placed about the nipple 80 to facilitate sealing to cooperating apparatus to be described.

When assembled as shown in FIG. 5, the cartridge battery 1 is adapted to be connected to an outlet assembly comprising a base plate 90 which may be conveniently formed integral with legs 91 to support the apparatus on a convenient table or other supporting surface preferably closely adjacent to the coating head 7. As indicated in FIG. 5, the base plate 90 may be formed with bores such as 92 to receive the heads 60 of the tie bolts 58 with clearance.

As shown in FIG. 5, the base plate 90 is fitted with a set of connectors generally designated 93, one for each of the cartridges 55 in the cartridge battery 1, to facilitate the connection of the cartridges to the individual output conduits, such as 4*a* and 4*e* in FIG. 5, of the set 4*a*–4*i*. Each of the connectors 93 may comprise a stepped cylindrical body portion 94 received in cooperating bores in the plate 90 and having a shoulder portion 95 cooperating with the end of an enlarged bore 96 formed in the plate 90.

A threaded nipple 97 formed on the connectors 93 cooperates with a nut 98 to hold an enlarged end 99 of each of the tubes such as 4*a* against the end of the fitting 93 through an intermediate packing washer such as an O-ring 100. The tubes such as 4*a* communicate through a reduced port 101 formed in the body portion of the connector 93 and a connecting enlarged bore 102 adapted to receive the nipple 80 formed on the corresponding cartridge such as 55*a*.

The outlet assembly is adapted to be connected to the cartridge battery 1 by means of a wing nut 103 formed with a flange 104 adapted to engage the plate base of the plate 90, and a shank portion 105 threaded as indicated at 106 to cooperate with corresponding threads 107 formed in an aperture in a boss 108 formed integral with the plate 57.

The individual cartridges 55 of the cartridge battery 1 are arranged to be connected to the fluid drive inlet conduits 3*a*–3*i*, of which typical conduits 3*a* and 3*e* are shown in FIG. 5, by means of a harness generally designated 109 comprising a cylindrical plate 110 in which connectors generally designated 111 are mounted that serve to connect the individual flexible conduits 3*a*–3*i* to the nipples 70 of the cartridges 55*a*–55*i*.

As shown in FIG. 5, each of the connectors 111 may comprise a nut 112 serving to hold a flange 113 formed on the end of each of the tubes such as 3*a* in contact with a threaded nipple 114, formed on the connector 11 and having a central bore 115, through an intermediate washer such as an O-ring 116. The fittings 111 are formed with nipples 117 protruding through corresponding bores in the plate 110, and secured as by nuts 118. A seal such as an O-ring 120 around each of the nipples 117 serves to form a seal when the assembly 109 is engaged with the cartridge battery 1.

As shown, the plate 110 may be formed with bores 125 to receive the wing nuts 59 with clearance.

The supply harness 109 may be connected to the cartridge battery 1 by means of a wing nut generally designated 126 formed with a flange 127 to engage the upper side of the plate 110, and having a threaded shank 128 passing through a bore in the plate 110 and cooperating with threads 129 formed in a central aperture in a boss 130 formed integral with the plate 56.

The fittings 111 may be provided with conventional check valves, not shown, to facilitate maintaining the lines leading to the cartridge battery 1 full of water and free of gas. Conventional details of this kind are known, will be well understood by the artisan, and are not shown to avoid unnecessary complication of the drawings and description.

The cartridges such as 55*a*–55*i* may be of any convenient capacity, such as from 1 to 2 liters apiece, sufficient to contain the maximum quantity of coating composition that will be dispensed for any particular layer in any particular coating run to be made, together with a supervening layer of drive fluid.

As shown in FIG. 5 for the typical cartridge 55*a*, each of the cartridges is provided with a split floating plug generally designated 131 and comprising an outer body portion 132 and a relatively moveable inner body portion 133. A valve actuator in the form of a T-shaped pin 134 is secured to the inner body portion 133 for purposes to be described.

As indicated in FIG. 5, the plug 131 is adapted to float in the cartridge such as 55*a*, when charged with a coating composition 135 and a superposed layer of drive fluid 137, with the interface 136 between the coating composition 135 and the drive fluid 137 intermediate the top and bottom of the plug. For this purpose, the fluid 137 is selected to have a density slightly less than the density of the coating composition 135.

For example, for the usual coating compositions applied in the manufacture of photographic products, the specific gravity of the coating composition may be somewhat greater than 1, and the drive fluid may be water with a specific gravity of 1. The components of the plug 131 are made to have a net specific gravity between these values. For this purpose, the inner and outer body portions of 132 and 133 of the split floating plug 131 may each be made of polyethylene with a specific gravity of 0.93, and the pin 134 of stainless steel of a size such that the net specific gravity of the floating plug 131 will be 1.005. This specific gravity is convenient for use with water as the driving fluid and any coating fluid of a minimum specific gravity of 1.01.

Coating with the apparatus of the invention is carried out by first charging the individual cartridges 55 as will next be described. Referring to FIG. 5, with the cartridge battery 1 disassembled from the other apparatus as shown, the cartridge battery is disassembled by removal of the wing nuts 59 and tie bolts 58. The individual cartridges such as 55*a* through 55*i* are then disassembled, by removal of the caps 67 and the floating plugs 131. The valves such as 76 in FIG. 5 may be opened, and the body portions 64 of the cartridges washed and dried.

Next, the cartridge valve 76 is closed, with the valve body such as 74 in the position shown in the cartridge 55*a* in FIG. 5, and each cartridge is charged with a quantity of coating composition 135 to a level dependent on the amount needed for a particular run. The split floating plug 131 is then placed in the cartridge, to float on the coating composition 135.

Figure 6:
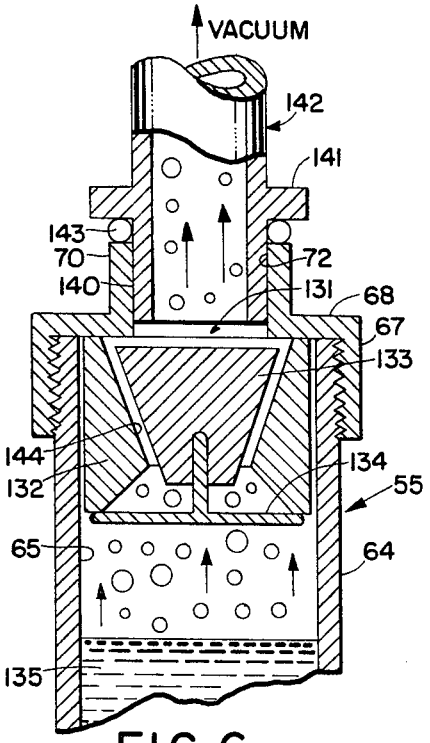
FIG. 6 is a fragmentary diagrammatic elevational sketch, with parts shown in cross section and parts broken away, and on an enlarged scale, illustrating the operation of a split plug forming a portion of the apparatus of FIG. 5 in one position.

Referring to FIG. 6, the cap 67 is now replaced on the cartridge 55 and the apparatus is connected to vacuum by means schematically indicated as a vacuum line 142 formed with a nipple 140 adapted to fit into the bore 72 in the nipple 70 of the cartridge. The nipple may be formed integral with a flange 141 by means of which the connecting line 142 can be sealed to the inlet nipple 70 by means of an intermediate O-ring 143. Upon connection of a vacuum pump to the line 142, by means of an intermediate liquid collection chamber if so desired, the coating composition is then degassed to remove any gases, such as air, that may dissolved in it. In this process, a certain amount of foaming will usually take place during which bubbles and frothwill carry the split floating plug 131 upwardly in the container until the gasses force the central body portion 133 out of contact with the body portion 132. To this end, the outer body portion 132 is formed with a tapered recess 144. The inner body portion 133 is formed as a tapered plug to form a seal with the outer body portion 132 when in the position shown in FIG. 7, and to rise up and admit gas through a passage between the portions 132 and 133 in the position shown in FIG. 6, where the inner body portion 133 is held against sealing the outlet of the cap 67 by means of the T-pin 134 engaging the base of the outer body.

After the degassing of each cartridge 55 in the manner illustrated in connection with FIG. 6, the vacuum line 142 is removed and the cartridge 55 is topped off with water 137. The cartridge is then in the condition shown in FIG. 5 for the cartridge 55*a*, with the split plug 131 floating in the vicinity of the interface 136 between the coating composition 135 and the drive fluid 137. The topping off process is best performed after the cartridges 55 are replaced in the cartridge battery 1, during which process the tie bolts 58 and wing nuts 59 are replaced and the cartridge battery 1 is connected to the outlet assembly comprising the base plate 90.

Figure 7:
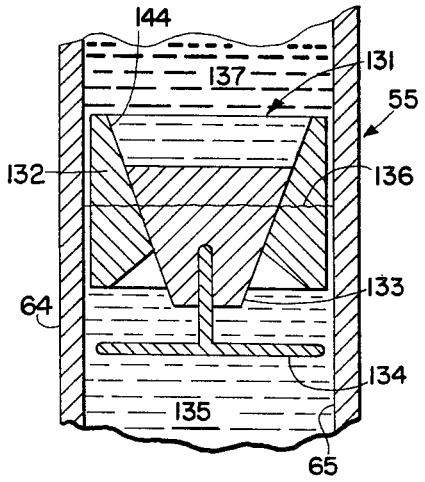
FIG. 7 is a view similar to FIG. 6 showing the opeation of the split plug of FIG. 5 in a second position.
Figure 8:
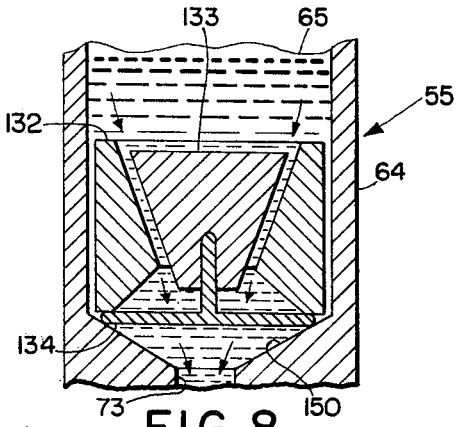
FIG. 8 is a view similar to FIGS. 6 and 7, showing the split plug of FIG. 5 in its lowermost position.
Figure 9:
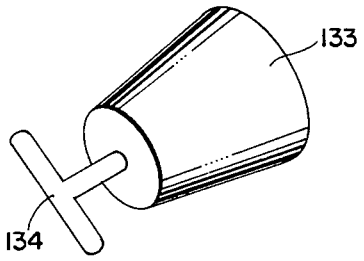
FIG. 9 is a diagrammatic three-quarter perspective sketch of an inner plug and actuating member forming a portion of the apparatus of FIGS. 5–8.

Before and during the coating operation, the split floating plug 131 will assume a position such as that shown in FIG. 7, in which the inner body portion 133 falls down into the conical recess 144 formed in the outer body 132, being carried to that position by the small excess specific gravity contributed to the central body portion 133 by the metal pin 134. As indicated in FIGS. 6–8, the outer body portion 132 of the split floating plug 131 need not be and preferably is not a tight fit in the cylindrical bore 65 formed in the cylindrical body portion 64 of the cartridges 55. The clearance may be from 5 to 10 mils, for example. It has been found that this clearance facilitates free movement of the plug in response to the hydrodynamic forces acting on it, and does not result in mixing between the drive fluid 137 and the coating composition 135.

Toward the end of the dispensation of a charge of coating composition, the T-pin 134 will engage the base 150 of the bore 65 in the body portion 64 of the cartridge 55, driving the central body portion 133 upwardly to clear the outer body portion 132 as shown in FIG. 8. This action will allow flow to continue out of the cartridge as the last of the coating composition is expelled from the cartridge without hydraulic shock that would cause a discontinuity in the coating.

Figure 10:
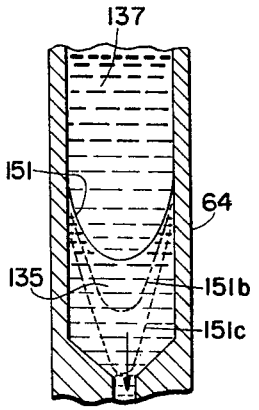
FIG. 10 is a fragmentary diagrammatic cross-sectional view of a portion of the apparatus of FIGS. 5–8, omitting the split plug and illustrating the mode of operation of the apparatus in its absence.

FIG. 10 illustrates a phenomenon that it is desired to avoid, and which is prevented by the use of the split floating plug 131. In particular, without the plug, as the drive fluid 137 is dispensed by the positive displacement pump, it does not move in a "plug flow" manner but would form a generally paraboloidal interface 151 with the coating composition 135. This interface will continue to extend further and further into the coating composition as the drive fluid is dispensed, as indicated at 151*b* and 151*c* in FIG. 10. After approximately one half of the coating fluid has been pushed out, the parabolic spike of drive fluid down the center will begin to exit from the cartridge. This limits the maximum utilization of the coating composition in the cartridge. In addition, the split floating plug 131 greatly facilitates the degassing operation described above in connection with FIG. 6.

In practice, as many of the cartridge batteries 1 as may be desired may be provided, so that the operations of preparing the cartridges for a coating run need not interfere with the speed with which a succession of runs can be carried out.

While the invention has been described with respect to the details of a specific embodiment, many changes and variations will occur to those skilled in the art upon reading this description, and such can obviously be made without departing from the scope of the invention.

Having thus described the invention, what is claimed is:

1. Coating apparatus, comprising, in combination: a cartridge battery comprising a plurality of fluid containers each adapted to contain, in superposed layers, a quantity of fluid coating composition and a quantity of drive fluid having a density less than the density of the coating composition and means for supporting said containers in a vertically oriented array; a fluid drive system comprising a set of positive displacement pumps, one for each container, each adapted to be connected to a different one of said containers to supply drive fluid to said containers and dispense coating fluid from said containers at rates equal to the rates of flow of drive fluid provided by said pumps; a coating head for applying coating compositions to a web; and means for connecting said containers to said coating head to deliver coating compositions to said coating head simultaneously at rates equal to the rates of flow of drive fluid supplied by said pumps.

2. Dispensing apparatus, comprising means forming a container having a vertically oriented cylindrical chamber containing a layer of a first liquid of density $\rho_1$ superposed on a layer of a second liquid of density $\rho_2$, where $\rho_2<\rho_1$; and a split plug floating in said chamber with an upper portion immersed in said first liquid and a lower portion immersed in said second liquid, said plug comprising an outer cylindrical body portion conforming in shape to each cylindrical chamber and fitting said chamber with clearance, said outer body portion being formed with a downwardly converging central frusto-conical aperture, an inner tapering frustro-conical plug received in said aperture and movable between a lower position closing said aperture and a higher position clearing said aperture, and means connected to said inner plug and adapted to contact said outer body portion in the higher position of said inner plug to prevent the movement of said inner plug out of said aperture, said plug having a net density $\rho_3$, where $\rho_2<\rho_3<\rho_1$.

3. Valve means for separating a drive fluid of density $\rho_1$ from a drive fluid of density $\rho_2$ in a vertically oriented conduit, comprising an outer body of right circular cylindrical cross section formed with a frustro-conical central aperture, an inner frustro-conical body in said central aperture and movable between a first position closing said aperture and a second position clearing said aperture, and stop means connected to said inner body and adapted to contact said outer body when said inner body is moved to its second position to limit the travel of said inner body away from said first position.

4. A cartridge battery for dispensing a plurality of liquid coating compositions at different flow rates, comprising a plurality of cartridges, means for supporting said cartridges in a spaced array, each of said cartridges comprising a body portion formed with a cylindrical chamber adapted to contain a quantity of fluid coating composition having a density $\rho_1$ and a superposed layer of drive fluid having a density $\rho_2<\rho_1$, a cap adapted to be detachably connected to said body portion and formed with an aperture for admitting drive fluid to said cylindrical chamber, means forming an outlet passage in said body portion communicating with said chamber, valve means in said outlet passage for opening and closing said outlet passage, and a separable float valve in said chamber comprising an outer annular member loosely fitting said chamber and an inner member received in said outer member and movable between a first position forming a closed plug with said outer member and a second position forming an annular flow channel with said outer member, said members having a net density $\rho_3$, where $\rho_2<\rho_3<\rho_1$.

5. The apparatus of claim 4, in which said outer member has a density $\rho_4$, where $\rho_4<\rho_1$ and said inner member has a density $\rho_5<4$.

6. The apparatus of claim 4, in which said outer member comprises a cylindrical body formed with intersecting conical recesses converging to a common diameter intermediate the ends of said body and said inner member comprises a conical body received in said recesses, said conical body fitting a first of said recesses to form a plug in said first position and clearing said first recess to form an annular channel with said cylindrical body in said second position, and means formed on one of said bodies to engage the other of said bodies in said second position to prevent the escape of said inner member from said outer member.

7. The apparatus of claim 4, in which said outer member comprises a cylindrical body formed with intersecting conical recesses converging to a common diameter intermediate the ends of said body and said inner member comprises a conical body received in said recesses, said conical body fitting a first of said recesses to form a plug in said first position and clearing said first recess to form an annular channel with said cylindrical body in said second position, and means formed on one of said bodies to engage the other of said bodies in said second position to prevent the escape of said inner member from said outer member.

8. Coating apparatus, comprising, in combination: a cartridge battery comprising a plurality of fluid containers each adapted to contain, in superposed layers, a quantity of fluid coating composition and a quantity of drive fluid having a density less than the density of the coating composition, and means for supporting said cartridges in a vertically oriented array; plug means in each cartridge having a net density intermediate the densities of the drive fluid and the coating composition for floating in the vicinity of the interface between the drive fluid and the coating composition to substantially isolate the drive fluid from the coating composition during movement of said interface; a fluid drive system comprising a set of positive displacement pumps, one for each cartridge, each adapted to be connected to a different one of said cartridges to supply drive fluid to said cartridges and dispense coating fluid from said cartridges at rates equal to the rates of flow of drive fluid provided by said pumps; a coating head for applying coating compositions to a web: and means for connecting said cartridges to said coating head to deliver coating compositions to said coating head.

9. Coating apparatus, comprising, in combination: a cartridge battery comprising a plurality of cartridges and means for supporting said cartridges in a vertically oriented array; each of said cartridges comprising a fluid container having a uniform cylindrical bore adapted to contain a quantity of coating composition having a density $\rho_1$ and a superposed layer of a drive fluid having a density $\rho_2<\rho_1$, and a split plug in said bore; said split plug comprising an outer cylindrical body portion conforming in shape to said bore and fitting said bore with clearance, said outer body portion being formed with a downwardly converging central frustro-conical aperture, an inner tapering frustro-conical plug received in said aperture and movable between a lower position closing said aperture and a higher position clearing said aperture, and means connected to said inner plug and adapted to contact said outer body portion in the higher position of said inner plug to prevent the movement of said inner plug out of said aperture, said plug having a net density $\rho_3$, where $\rho_2<\rho_3<\rho_1$; a fluid drive system comprising a set of positive displacement pumps, one for each cartridge, each adapted to be connected to a different one of said cartridges to supply drive fluid to said cartridges and dispense coating fluid from said cartridges at rates equal to the rates of flow of drive fluid provided by said pumps; a coating head for applying coating compositions to a web; and means for connecting said cartridges to said coating head to deliver coating compositions to said coating head.

10. A cartridge battery for dispensing a plurality of liquid coating compositions at different flow rates, comprising a plurality of cartridges, means for supporting said cartridges in a spaced array, each of said cartridges comprising a body portion formed with a cylindrical chamber adapted to contain a quantity a fluid coating composition having a density $\rho_1$ and a superposed layer of drive fluid having a density $\rho_2<\rho_1$, and a separable float valve in said chamber comprising an outer annular member loosely fitting said chamber and an inner member received in said outer member and movable between a first position forming a closed plug with said outer member and a second position forming an annular flow channel with said outer member, said members having a net density $\rho_3$, where $\rho_2<\rho_3<\rho_1$.

* * * * *